US006050433A

United States Patent [19]

Russell et al.

[11] Patent Number: 6,050,433

[45] **Date of Patent: *Apr. 18, 2000**

[54] CONTAINER CLOSURE

[75] Inventors: Allin Nicholas Russell; James Richard Manley, both of Auckland, New Zealand

[73] Assignee: The Hanger Company Limited, Auckland, New Zealand

[ * ] Notice: This patent issued on a continued prosecution application filed under 37 CFR 1.53(d), and is subject to the twenty year patent term provisions of 35 U.S.C. 154(a)(2).

[21] Appl. No.: 08/921,392

[22] Filed: Aug. 29, 1997

[30] Foreign Application Priority Data

Sep. 2, 1996 [NZ] New Zealand ..... 299274
Nov. 21, 1996 [NZ] New Zealand ..... 299800

[51] Int. Cl.[7] ..... B65D 51/18

[52] U.S. Cl. ..... 215/229; 215/235; 215/309; 215/388; 220/259; 220/213; 220/252; 220/345.3; 220/709; 220/367.1; 222/528

[58] Field of Search ..... 222/528, 529; 215/388, 322, 235, 229, 902, 309; 220/213, 256, 254, 259, 252, 345, 351, 705, 707, 708, 709, 367.1, 714, 715, 713, 345.1, 345.2, 345.3

[56] References Cited

U.S. PATENT DOCUMENTS 2,529,817 11/1950 Russell ..... 220/252 X
2,844,267 7/1958 Petriccione ..... 215/229 X
3,294,293 12/1966 Johns ..... 222/528 X
3,337,098 8/1967 Johns ..... 222/528 X
3,858,773 1/1975 Del Bon ..... 222/529 X
4,485,963 12/1984 Panicci ..... 215/902 X
4,881,668 11/1989 Kitterman et al. .
4,925,043 5/1990 Dinand ..... 215/322
5,065,909 11/1991 Pino et al. ..... 215/902 X
5,150,815 9/1992 Saklad ..... 215/388 X
5,188,283 2/1993 Gu ..... 220/708 X
5,203,468 4/1993 Hsu ..... 220/708 X
5,242,079 9/1993 Stephens et al. ..... 220/367.1 X
5,259,538 11/1993 Tardif ..... 222/528
5,273,172 12/1993 Rossbach et al. .
5,339,982 8/1994 Tardif ..... 215/229 X
5,346,081 9/1994 Lin ..... 215/229
5,361,934 11/1994 Spence, Jr. ..... 220/709 X
5,415,312 5/1995 Mueller .
5,518,142 5/1996 Lin ..... 220/709 X
5,520,304 5/1996 Lin ..... 215/388 X
5,579,948 12/1996 Lin ..... 215/229 X

*Primary Examiner*—Stephen P. Garbe
*Assistant Examiner*—Robin A Hylton
*Attorney, Agent, or Firm*—David A. Farah; Sheldon & Mak

[57] ABSTRACT

A container closure includes an access, which can receive a drinking straw, which is able to be folded down into a groove by the pivotal movement of member, which closes off the drinking straw by engaging it across an upstanding flange or projection.

6 Claims, 6 Drawing Sheets

CONTAINER CLOSURE

BACKGROUND

The present invention relates to improvements in container closures and more particularly, but not exclusively, to closures for bottles or like containers. For simplicity, the present invention will be hereinafter described in respect of a bottle closure, but it is to be understood that a closure for any other type of container is envisaged to be within the applications to which the present invention could be put.

In drinking bottle closures, various proposals have been put forward for the controlled access to the bottle contents. In many situations, there is a need to have speedy and efficient access to the bottle contents by means of a straw or the like.

In some past proposals, a drinking straw can have a first substantially vertical position, when drink can be supplied from the bottle and a second, folded over, position resulting from the sliding of the bottle closure, when flow of drink from the bottle is terminated. In one such proposal, the bending over of the straw also results in the straw closing off an air vent connecting with the bottle interior.

Other past proposals have included the well known pop-up type closure where the raising or lowering of a pop-up valve on the top of the closure controls access to the bottle contents.

All the previous proposals for bottle closures have been found to have certain disadvantages relating to their efficiency, complexity and/or cost.

It is, thus, an object of a preferred embodiment of the invention to provide a bottle closure which will overcome or at least obviate disadvantages in bottle closures available to the present time or which at least will provide the public with a useful choice.

Further objects of this invention will become apparent from the following description.

SUMMARY

According to one aspect of the present invention, there is provided a container closure having an access means which, in use, can provide external access to the interior of a container, said access means being adapted to receive in use a drinking straw which straw can have a substantially vertical position for drinking purposes, but can be folded over by a pivotal means as it moves to a closed position, said pivotal means being able to pivot between first and second positions when it opens and closes the access means respectively, said access means having an edge portion over which said drinking straw can be folded, which edge portion acting to nip said drinking straw and substantially stop flow of liquid therethrough from the interior of said container.

In one embodiment, the pivotal means comprises a hood which can pivot about a body portion. In one embodiment, the body portion includes a groove in which the drinking straw can be accommodated as it is folded down as the pivotal means moves to its closed position.

According to a further aspect of the present invention, there is provided a container closure substantially as herein described, with reference to the accompanying drawings. According to a still further aspect of the present invention, there is provided a container including a closure substantially as herein described, and/or with reference to the accompanying drawings.

DRAWINGS

Further aspects of this invention, which should be considered in all its novel aspects, will become apparent from the following description, given by way of example of possible embodiments thereof, and in which reference is made to the accompanying drawings where:

DESCRIPTION

Figure 1:
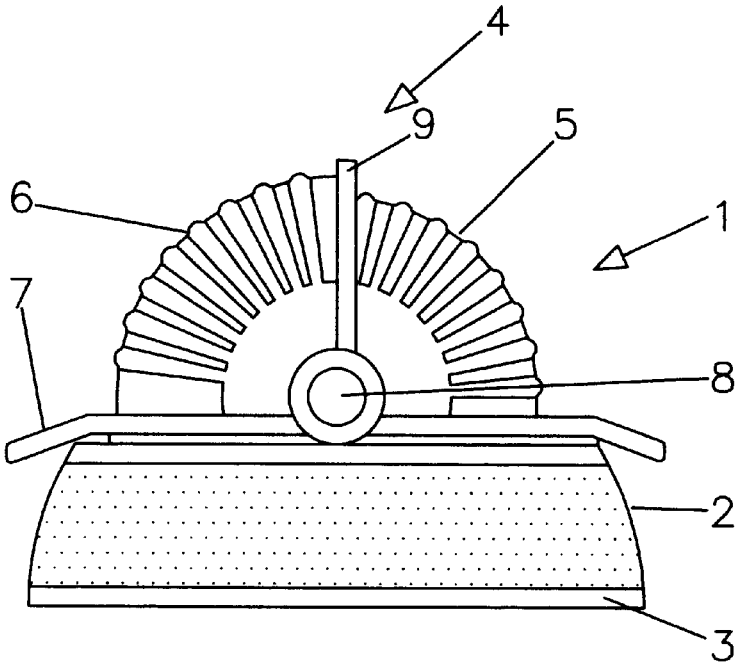
FIG. 1 shows a side view of a closure according to one embodiment of the present invention in its closed position.

Referring to the accompanying drawings, a closure for a bottle or other container is referenced generally by arrow 1. The closure 1 may be formed from any suitable material and from any suitable technique, although a molded plastic closure has been found to be satisfactory, a plastic surface facilitating the closure being kept clean as is especially necessary when the container is used for containing a liquid drink or food.

The closure 1 is shown with a base portion 2 and the bottom edge portion 3. Extending upwardly from the base portion 2 is a body portion 40 about which a top portion 4 is shown provided. The top portion 4 is shown as including a pair of quadrants 5, 6. Both of the quadrants 5, 6 may have surface decoration 41 to enhance their appearance. One of the quadrants 6 is shown pivotally mounted at 8 to the body portion 40 enabling the quadrant 6 to be lifted by means of lever 7 from its closed position shown in FIG. 1 to its open position shown in FIG. 2. As will be seen in FIGS. 1 and 2 for example, in its closed position, the lever 7 is adjacent the base portion 2 with an opposite edge 9 in a substantially vertical position, whereas in the open position shown in FIG. 2, those positions are effectively reversed. The quadrant 6 in this embodiment functions in the nature of a pivotal hood.

Figure 4:
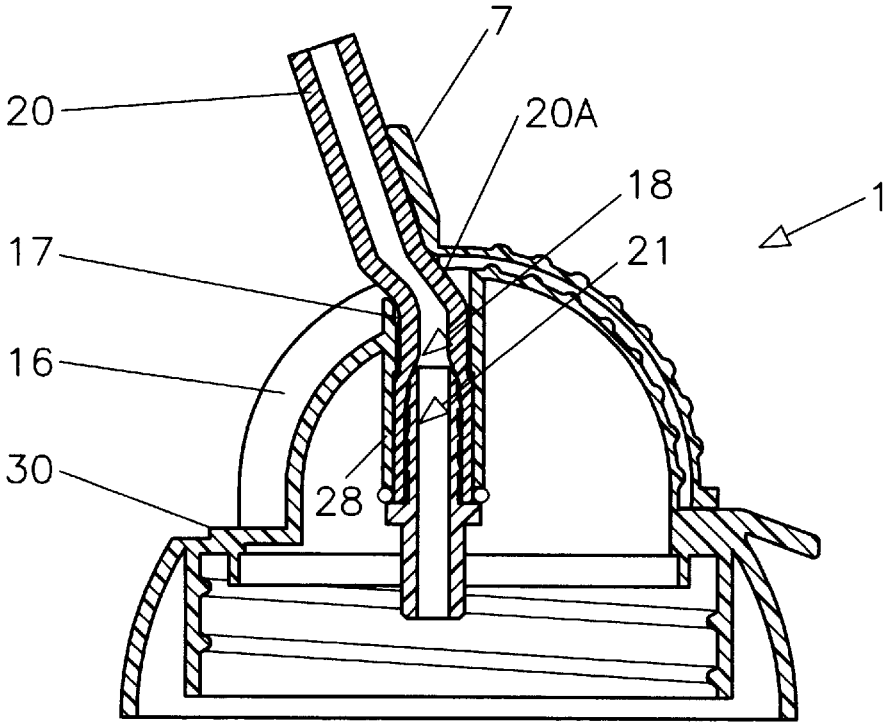
FIG. 4 shows a cross-sectional view of the closure of the preceding figures in its open position.
Figure 5:
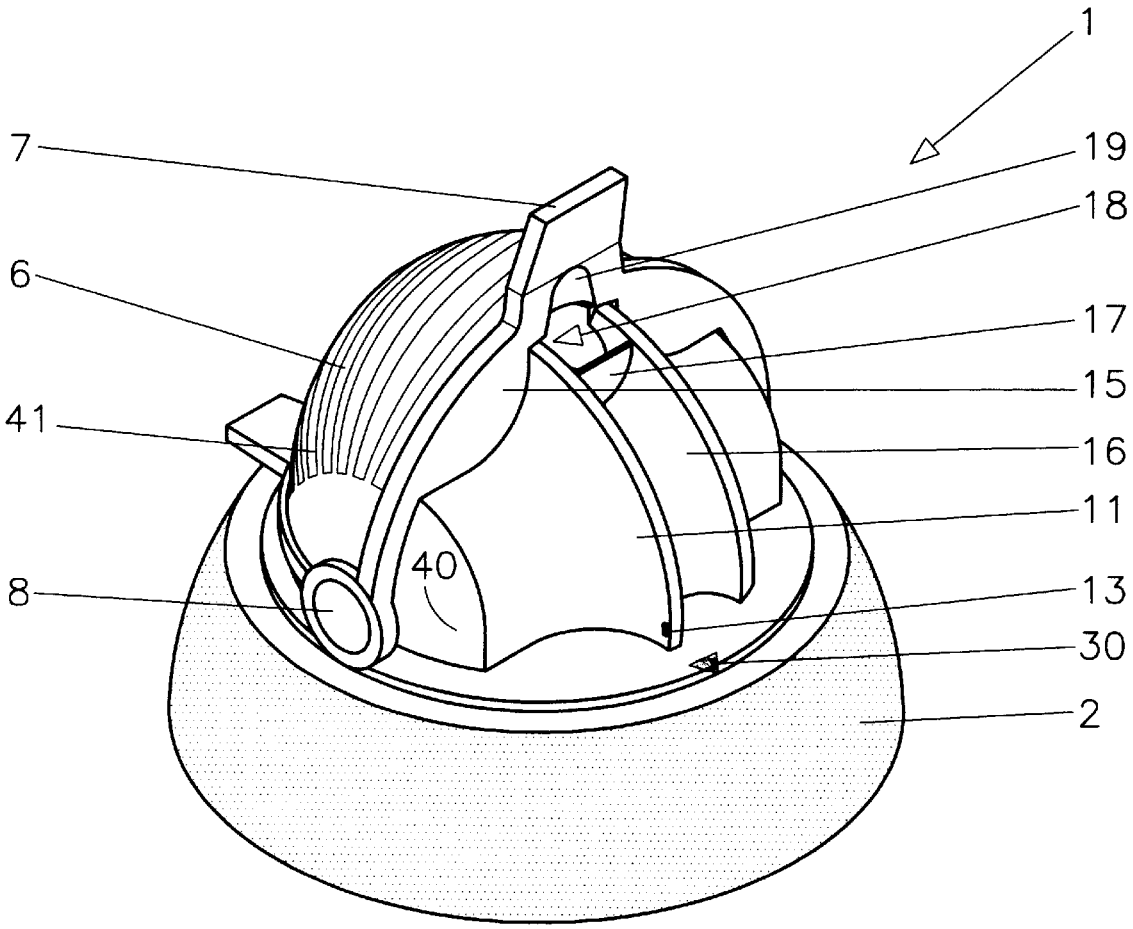
FIG. 5 shows an isometric view of the closure of the preceding figures in its open position.

As is shown particularly in FIG. 5 for example, the inner and bottom edge 15 of the quadrant 6 may be contoured so as to provide a controlled sliding relationship with similarly contoured surfaces 11 of the body portion 40. The body portion 40 is shown provided with a groove or channel 16 which can accommodate a straw 20, which as shown in FIGS. 3 and 4, can be folded over 20A as the quadrant 6 moves between its open and closed positions.

Figure 3:
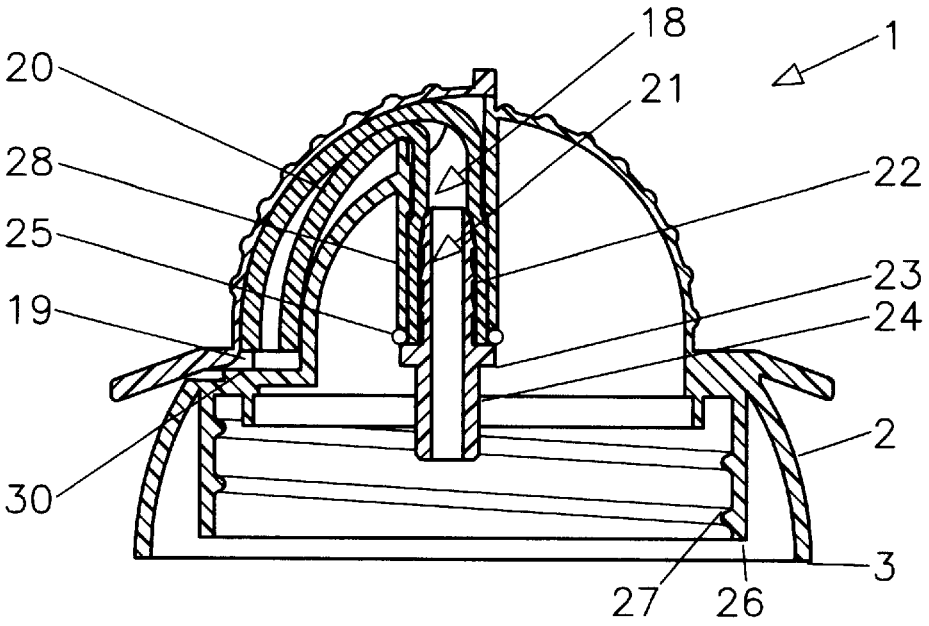
FIG. 3 shows a cross-sectional view through the closure of the preceding figures in its closed position.

As seen particularly in FIGS. 3 and 5 for example, at the top of the groove 16 an upstanding flange or projection 17 is provided over which the folded straw 20 can pass so that the straw 20 is nipped at that place so as to be closed off. This stops or substantially stops the flow of liquid through the straw 20. The lever 7 may be associated with an inner recess 19, see FIGS. 3 and 5 particularly, so that when the quadrant 6 is in its closed position, any residual contents in the straw 20 are able to escape from the closure 1.

As seen in FIG. 4 particularly, the straw 20 is positionable within an access 18 connecting with the interior of the closure 1 and in use with the interior of a container. The access 18 is shown including a tube or bore 28 which can accommodate a straw connector 21. The straw connector 21 is shown provided with a grooved end 22 to facilitate a firm connection with the end of the straw 20. The connector end 22 is shown extending to a flange 23 and a bottom projecting tube 24. A crimping ring 25 may be provided as shown to hold the connector 21 in position.

Figure 6:
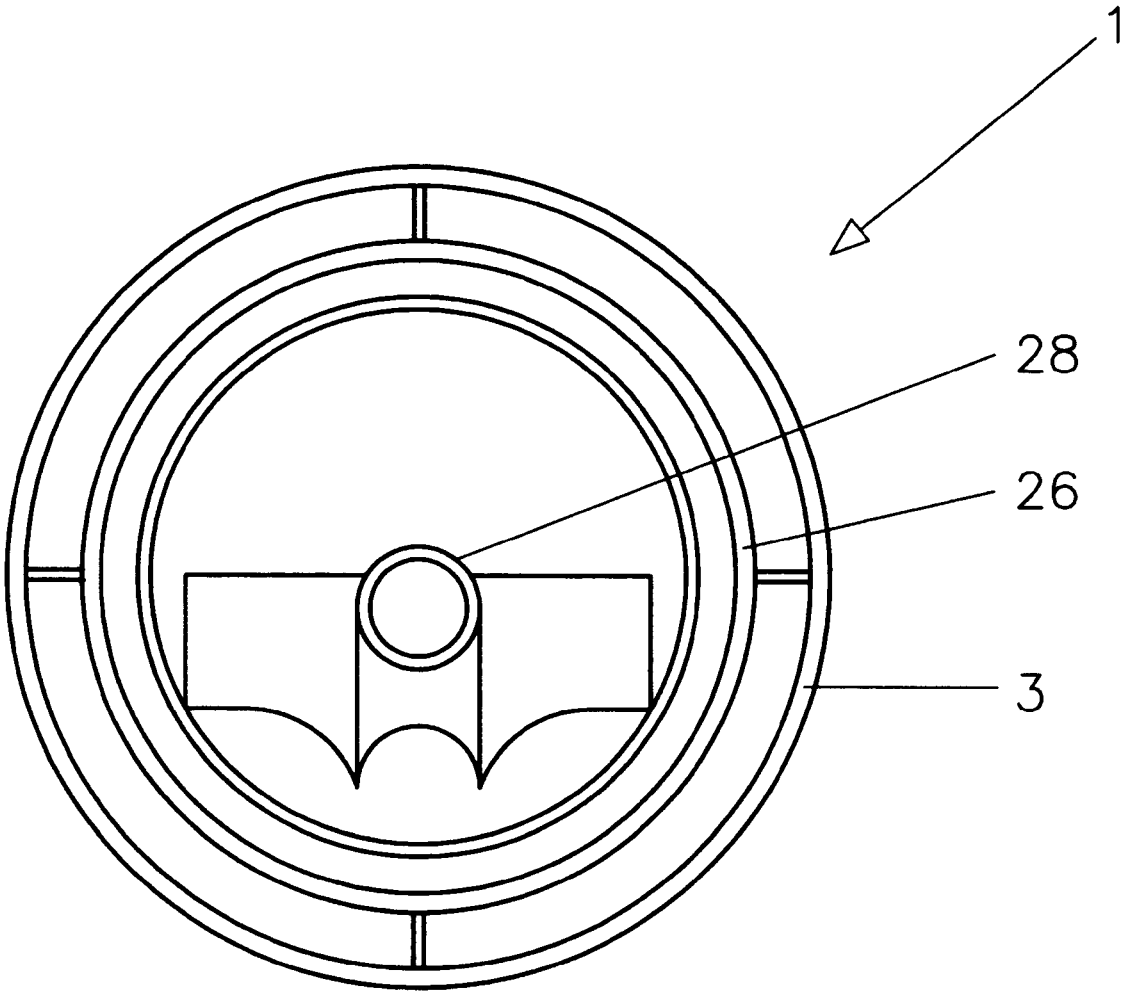
FIG. 6 shows an underneath view of the closure of the preceding figures.
Figure 7:
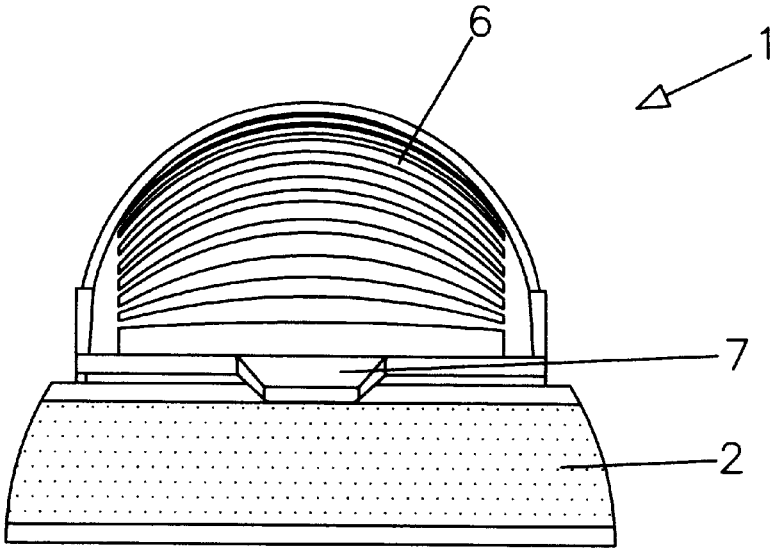
FIG. 7 shows a front view of the closure of the preceding figures in its closed position.
Figure 8:
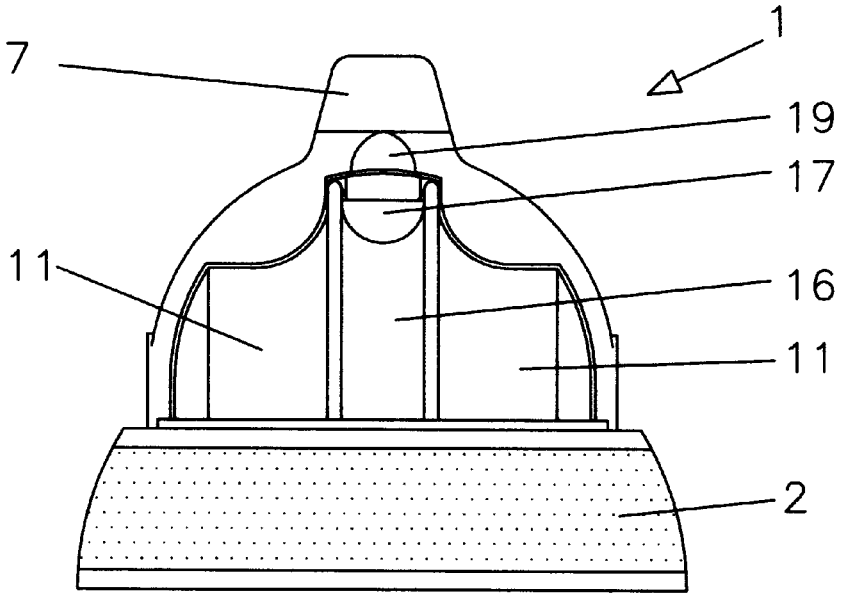
FIG. 8 shows a front view of the closure of the preceding figures in its open position.

As seen particularly in the underneath view in FIG. 6, the base portion 2 may be provided with a threaded internal rim 26 having thread 27, which can engage with the container neck.

It will be appreciated that in this embodiment of the invention, with the closure 1 fitted onto a container, the only access to the container interior will be through the straw 20 and the access 21. Thus the applicant has found that separate air vents into the container may not be necessary to enable liquid to be drawn from the container provided the container walls are flexible to enable fluid in the container to effectively be pushed out by compressing the walls. However, some rigidity for the container walls may be required to avoid them imploding as liquid is drawn out through the straw 20.

It is emphasized that while the closure 1 is shown in the drawings as being a discrete member, it could be provided as an integral member forming part of a container.

Figure 2:
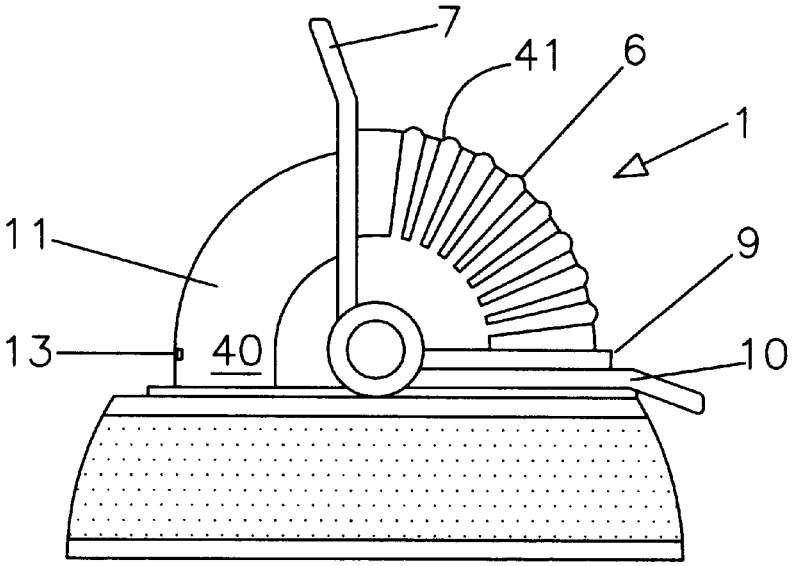
FIG. 2 shows the closure of FIG. 1 in its open position.

As will be seen particularly in FIGS. 1 and 2, the other quadrant 5 may merely provide a substantially symmetrical match for the quadrant 6 and may form part of the fixed body portion 40 about which the quadrant 6 can pivot. As seen particularly in FIG. 2, and also in FIG. 4, as the quadrant 6 pivots between its open and closed positions, it will slide over the quadrant 5 and in the open position the edge 9 of the quadrant 6 is shown abutting the bottom edge 10 of the quadrant 5.

As seen particularly in FIGS. 2 and 5, the body portion surfaces 11 may include projections 13 over which the inner surfaces 15 of quadrant 6 can engage thus acting to tend to hold the quadrant 6 in its closed position, although not unduly hindering the lifting of the quadrant 6 over the projections 13 when required.

Figure 9:
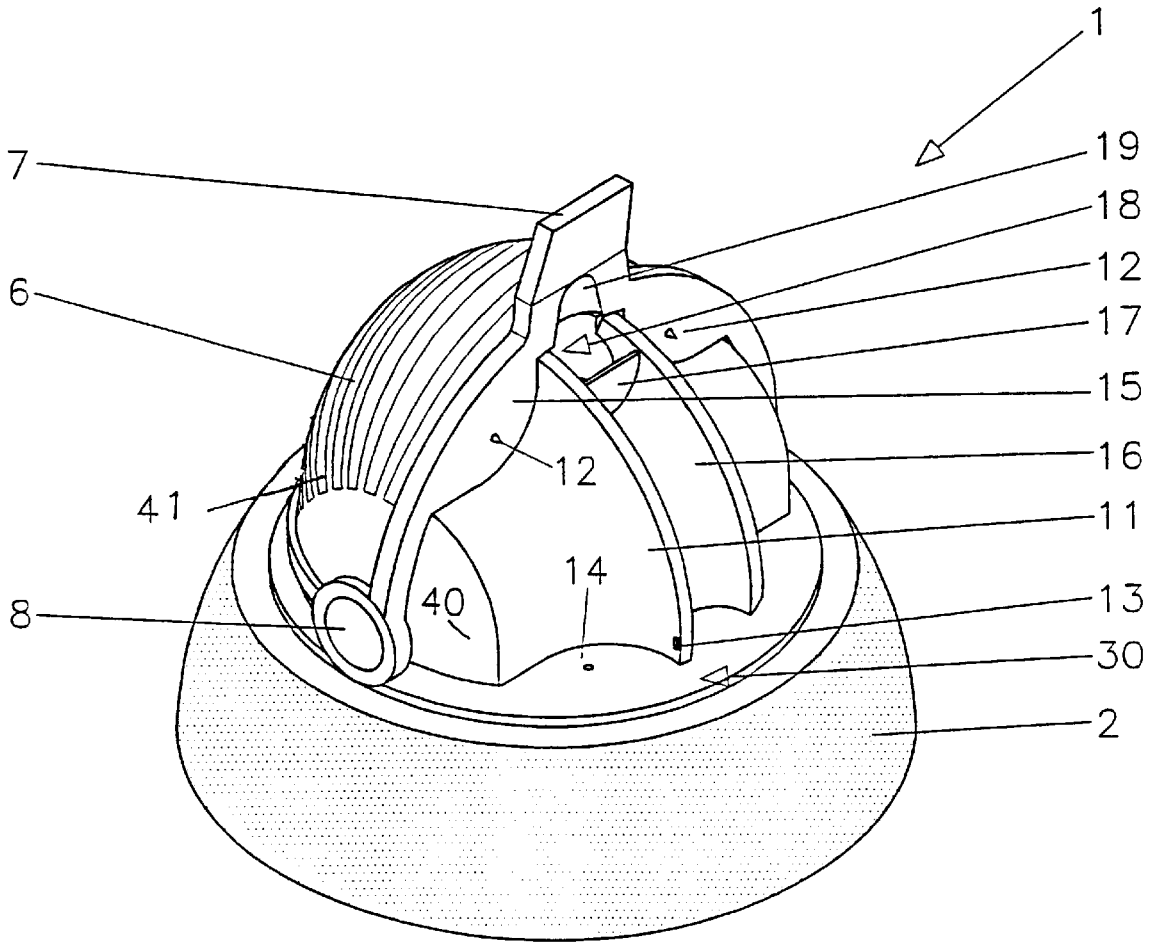
FIG. 9 shows an isometric view of a further embodiment of the invention in its open position.

Referring now to FIG. 9 in a further embodiment, the top face 30 of the base portion 2 is shown provided with a pair of air vents 14, which will provide an air connection with the interior of the closure 1 and the container. These vents 14, more or less can be provided as appropriate, can be closed off when the quadrant 6 is in its closed position by respective pins or projections 12 receivable in a respective vent 14.

Where in the foregoing description reference has been made to specific components or integers of the invention having known equivalents then such equivalents are herein incorporated as if individually set forth. Although this invention has been described by way of example and with reference to possible embodiments thereof it is to be understood that modifications or improvements may be made thereto without departing from the scope of the invention, as defined in the appended claims.

We claim:

1. A pivoting closure cap for closing a container having a top edge and an interior, the cap comprising:

a base portion configured to fit onto the top edge of a container;

a body portion attached to the base portion, the body portion including an accessing means therethrough, the accessing means including a drinking straw inserted into a channel within the accessing means; and a generally hemispherical top portion including a first quadrant and a second quadrant;

where the first quadrant is fixedly attached to the base portion and where the second quadrant is pivotally attached to the base portion allowing the second quadrant to pivot over the first quadrant from an open position allowing external access through the accessing means into the interior of a container through the straw, to a closed position causing the straw to fold over toward the base portion preventing external access into the interior of a container through the straw, and the second quadrant has an edge which is adjacent the body portion when the second quadrant is in the closed position; and where the second quadrant further includes an inner recess adjacent the edge of the second quadrant which allows residual liquid in the straw to escape from the straw when folded and from the closure cap when the second quadrant is in the closed position.

2. The closure cap of claim 1, where the body portion further includes a first projection which provides an upper edge of the accessing means, and where pivoting of the second quadrant from the open position to the closed position causes the straw to fold over the first projection, thereby substantially stopping flow of liquid from the interior of a container through the straw.

3. The closure cap of claim 1, where the body portion includes a second projection that engages the second quadrant when the second quadrant is in the closed position to assist in maintaining the second quadrant in the closed position.

4. The closure cap of claim 3, where the second projection is a pin.

5. The closure cap of claim 1, where the body portion includes an air vent allowing external access into the interior of a container, and where the second quadrant further includes a third projection which engages the air vent when the second quadrant is in the closed position, thereby closing the air vent.

6. The closure cap of claim 1 in combination with a container, where the closure cap is affixed to the container thereby closing off the interior of the container except through the accessing means and except through one or more air vents present in the body portion when the second quadrant is in the open position.

* * * * *

UNITED STATES PATENT AND TRADEMARK OFFICE

CERTIFICATE OF CORRECTION

PATENT NO. : 6,050,433

DATED : April 18, 2000

INVENTOR(S) : Russell et al.

It is certified that error appears in the above-identified patent and that said Letters Patent is hereby corrected as shown below:

On the Cover page at line 3, replace:

"[54] Container Closure"

with

-- [54] Pivoting Closure Cap for a Container -- and column 1, line 1 , replace:

"CONTAINER CLOSURE"

with

-- PIVOTING CLOSURE CAP FOR A CONTAINER --

Signed and Sealed this

Sixth Day of March, 2001

*Attest:*

Nicholas P. Godici

NICHOLAS P. GODICI

*Attesting Officer*

*Acting Director of the United States Patent and Trademark Office*